US005839657A

United States Patent [19]

Fulton et al.

[11] Patent Number: 5,839,657

[45] Date of Patent: Nov. 24, 1998

[54] METHOD AND STRUCTURE FOR CREATING TERRAIN GRADE FOR ARTIFICIAL LANDSCAPES

[76] Inventors: C. Dwayne Fulton, Lake Rd 54-56, Woodland Cove, Lot 36; David L. Osment, Lake Rd 54-56, Alona Point, Lot 5B, both of Osage Beach, Mo. 65065

[21] Appl. No.: 780,852

[22] Filed: Jan. 9, 1997

[51] Int. Cl.[6] ..... A63H 18/04

[52] U.S. Cl. ..... 238/10 E; 238/10 C

[58] Field of Search ..... 238/10 R, 10 A, 238/10 B, 10 C, 10 E, 10 F

[56] References Cited

U.S. PATENT DOCUMENTS

| | | | |
|---|---|---|---|
| 2,120,251 | 6/1938 | Johnson | 238/10 E |
| 4,241,875 | 12/1980 | Vanderbrink | 238/10 R |
| 4,540,119 | 9/1985 | Neuhierl | 238/10 R |
| 4,826,076 | 5/1989 | Hesse | 238/10 A |

FOREIGN PATENT DOCUMENTS

| | | | |
|---|---|---|---|
| 2068754 | 8/1981 | United Kingdom | 238/10 E |
| 9206757 | 4/1992 | WIPO | 238/10 A |

*Primary Examiner*—S. Joseph Morano

*Attorney, Agent, or Firm*—Shook, Hardy & Bacon

[57] ABSTRACT

A method is provided for creating an incline for a roadbed on an artificial landscape that involves coupling a flexible section to a base in a desired location. The section has a top that extends at an angle relative to its bottom so that it increases in elevation from one end to the other. The section has a series of channels formed therein which allows the section to flex so that it can conform to a curve. The method further involves placing a second section in abutting relationship with the first section to form a roadbed with a continuously increasing or decreasing grade. In one embodiment, the method further includes placing a number of flexible sections in abutting relationship to form an incline that rises from a base to a desired elevation. The present invention also provides a flexible section for creating a roadbed for an artificial landscape. The section has a top that extends at an angle relative to its bottom so that the section increases in elevation from one end to the other. Further, the section has channels formed therein which allow it to be flexed in either direction. A first flexible section is provided that rises from a base to a higher elevation. A second section is provided which starts from the highest elevation of the first section and further increases in elevation. The second section and the first section can be placed in abutting relationship to form a roadbed having a continuous grade. Subsequent sections may be provided which further increase the elevation achieved.

17 Claims, 2 Drawing Sheets

METHOD AND STRUCTURE FOR CREATING TERRAIN GRADE FOR ARTIFICIAL LANDSCAPES

BACKGROUND OF THE INVENTION

The present invention relates to a novel method and structure for constructing a terrain grade for a model. More particularly, the invention is directed to a method and structure which can be used to form a model roadbed with a precise grade, and which can be placed in a radius if desired.

Railroading enthusiasts and hobbyists of all ages have long enjoyed the challenge of model railroading. One of the challenges faced by these hobbyists is constructing a realistic layout that accurately simulates an actual landscape. Before the layout can be constructed, it must first be designed. Designing the layout includes determining the scale, size and overall shape, as well as the time period to be modeled. Further, the modeler must decide what types of industries will be represented on the layout, whether a town will be included, as well as what natural formations, such as trees, lakes and mountains will be present. Certain limitations, such as the available space and the expense involved are, of course, considered when making the above decisions. Further, the layout will include a pattern for the track on which the train will travel. This pattern may involve elevational changes for the track, to simulate grades, bridges and tunnels. After the layout is designed, it must then be constructed.

In general, railroad transportation involves a locomotive that pulls the rolling stock, which may include passenger cars and freight cars. The locomotive and the rolling stock are supported and travel along a track that is in turn supported by a roadbed. Thus, in constructing a model railroad layout it is necessary to construct the roadbed upon which the track is placed. The term "roadbed" as used in this specification is meant to refer to the structure on which the track is placed. It is also known in the art to refer to this structure as the "sub-roadbed." The roadbed that is constructed must conform to the grades in the layout. Typically, the main lines of actual railroads have no more than a two percent grade. The branch lines of the railroads may, however, have grades of three or four percent. Greater grades are not typically found unless a mountainous area or other special situation is encountered. In a model layout however, the space limitations may dictate that a grade greater than two percent be used. The use of greater grades in a model layout allows the track to rise to a given elevation in a shorter distance, which conserves space. It is often necessary to increase or decrease in elevation while at the same time rounding a corner. In other words, it is often desired or necessary to continue a grade in a radiused orientation. This especially true in a model layout where limited space is a concern.

Previous methods for creating a graded roadbed for a model landscape have been difficult, time consuming, and noisy. The needed inclines or declines were typically constructed from wood and required the use of power tools, hammers and nails. The nature of the materials used made it difficult to construct an incline or decline with a uniform and continuous grade. The difficulty increased significantly when an incline or decline was desired to be curved so that a rise or fall in elevation could continue throughout a radius in the layout. Further, the previous methods and devices for constructing a terrain grade resulted in a relatively heavy roadbed. If the layout was desired to be somewhat portable, the added weight made it more difficult to relocate the layout.

Therefore, a method and a device are needed that can be used to quickly and easily create a relatively lightweight terrain grade for a roadbed on an artificial landscape. Further, a method and a device are needed that can be used to create a terrain grade for a roadbed on an artificial landscape in a radiused orientation.

SUMMARY OF THE INVENTION

It is an object of the present invention to provide a structure that can easily be mounted onto a base so that a model roadbed with an accurate, predetermined grade can be formed.

It is a further object of this invention to provide a structure that can easily be manipulated into a variety of radiuses while providing an accurate, predetermined grade, so that a roadbed can be formed that increases or decreases in elevation while rounding a curve.

It is yet another object of this invention to provide a structure that is lightweight and sturdy and that can be mounted onto a base without the need for special power tools to form a model roadbed with an accurate, predetermined grade.

It is a still further object of this invention to provide a method for creating a terrain grade for a model roadbed so that the roadbed has the grade and radius desired.

According to the present invention, the foregoing and other objects are obtained by a method for creating an incline for a roadbed on an artificial landscape that involves coupling a flexible section to a base in a desired location. The section has a top that extends at an angle relative to its bottom so that it increases in elevation from one end to the other. The section has a series of channels formed therein which allows the section to flex so that it can conform to a curve. The method further involves placing a second section in abutting relationship with the first section to form a roadbed with a continuously increasing or decreasing grade. In one embodiment, the method further includes placing a number of flexible sections in abutting relationship to form an incline that rises from a base to a desired elevation. Thereafter, the method involves placing a number of flexible riser sections of constant elevation in abutting relationship with the last incline section. The method further includes placing a number of flexible sections after the last of the riser sections to return to the base.

In another embodiment of the present invention, a flexible section is provided for creating a roadbed for an artificial landscape. The section has a top that extends at an angle relative to its bottom so that the section increases in elevation from one end to the other. Further, the section has channels formed therein which allow it to be flexed in either direction. In still another embodiment, a first flexible section is provided that rises from a base to a higher elevation. A second section is provided which starts from the highest elevation of the first section and further increases in elevation. The second section and the first section can be placed in abutting relationship to form a roadbed having a continuous grade. Subsequent sections may be provided which further increase the elevation achieved. In yet another embodiment, a plurality of sections are manufactured from a single block of material.

Additional objects, advantages, and novel features of the invention will be set forth in part in the description which follows, and in part will become apparent to those skilled in the practice of the invention. The objects and advantages of the invention may be realized and attained by means of the instrumentalities and combinations particularly pointed out in the appended claims.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE PREFERRED EMBODIMENTS

Figure 1:
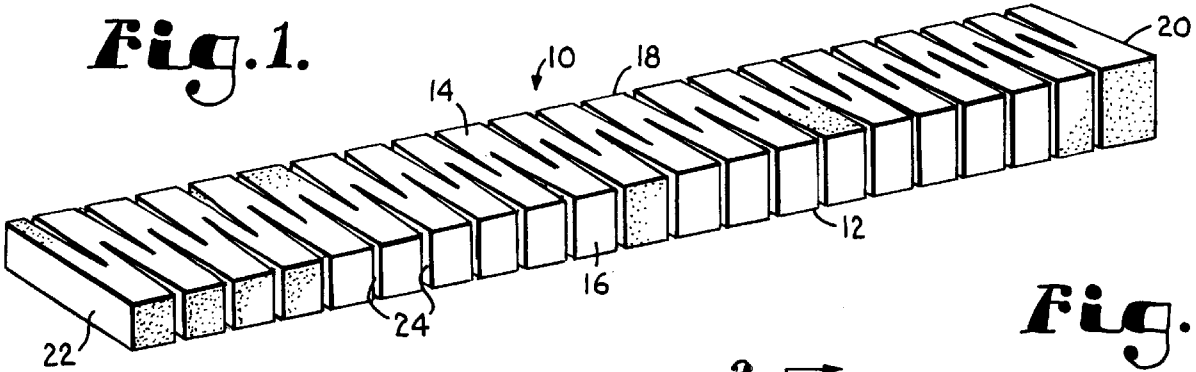
FIG. 1 is a perspective view of a flexible section according to the present invention.

A flexible graded section embodying the principles of this invention is broadly designated in the drawings by reference numeral 10. Section 10 is used to support a model train track 11 and to provide a grade for track 11. With initial reference to FIGS. 1 and 2, section 10 has a generally planar bottom surface 12, a top surface 14, and opposing parallel spaced apart side walls 16 and 18. Incline section 10 further has an end wall 20 and an additional end wall 22. Graded section 10 will always have an end wall 22 unless section 10 is desired to transition from a base or zero elevation to an increased elevation as can best be seen in FIGS. 7 and 8 and is more fully described below. Top surface 14 is angled with respect to bottom surface 12 so that section 10 increases in elevation from end wall 22 to end wall 20. The angle formed by top surface 14 and bottom surface 12 corresponds to a predetermined grade. In actual railroad systems, the main lines usually have no more than a two percent grade but the branch lines of the railroads may have a grade of three or four percent. In a model layout however, it is often desirable to use a three or four percent grade even on the main lines to allow the track to rise to a given elevation or fall from a given elevation in a shorter distance, so that the layout will fit within a limited space. Thus, top surface 14 is typically provided with a 2, 3 or 4% grade, it being understood that other grades could be used. In the railroading art, a 1% grade corresponds to a rise in elevation of one foot per one-hundred linear feet.

Figure 2:
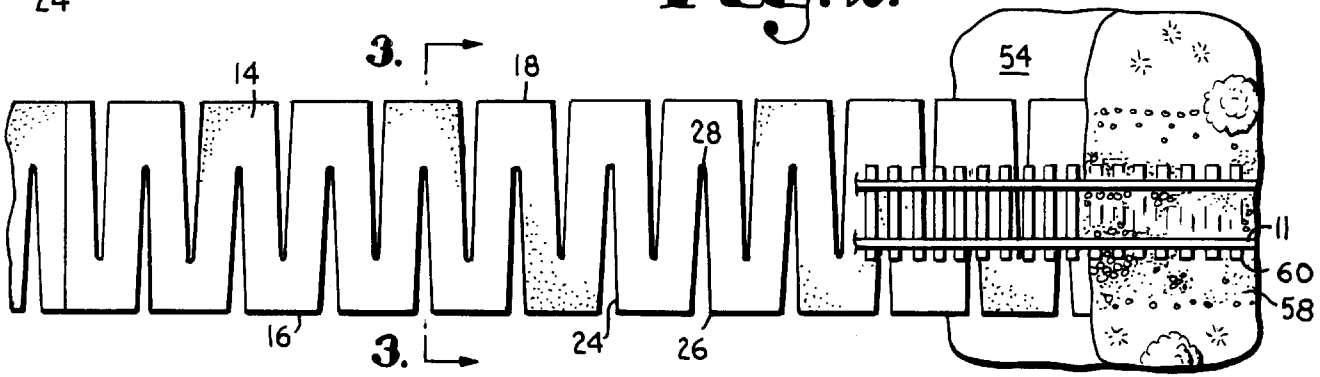
FIG. 2 is a top elevation view of the section of FIG. 1, shown attached to a base with a portion of track thereon and shown partially landscaped.
Figure 3:
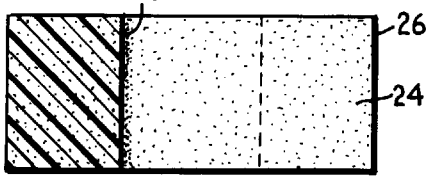
FIG. 3 is a cross sectional view of the section of FIG. 2, taken along line 3—3 of FIG. 2.
Figure 6:
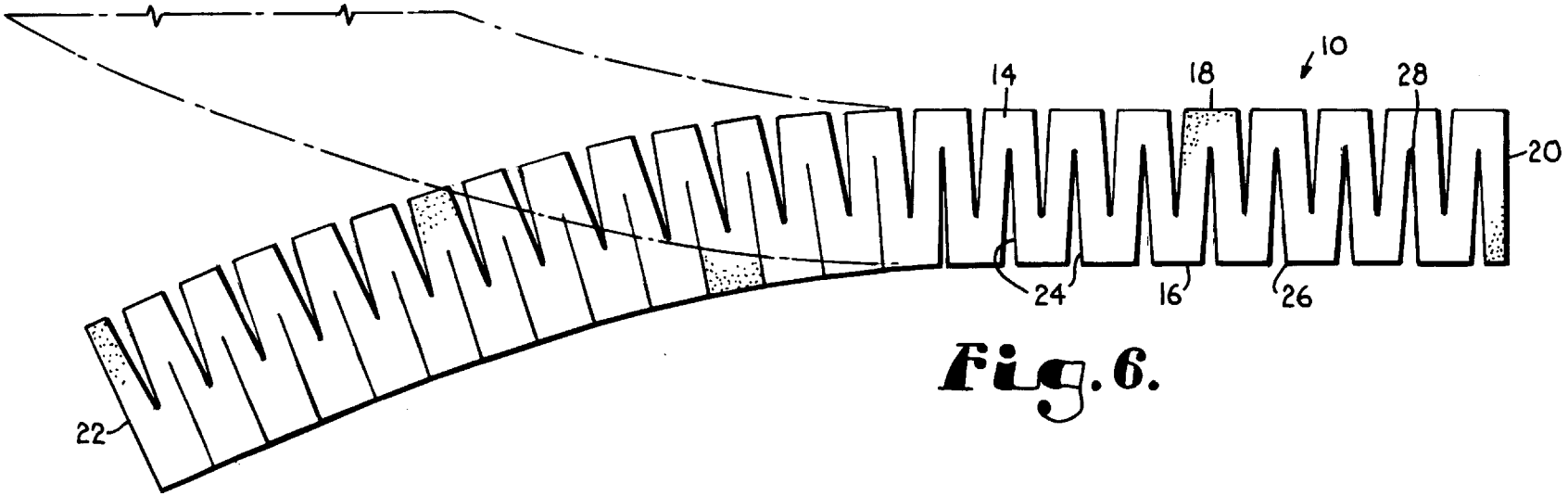
FIG. 6 is a top elevation view similar to that of FIG. 2, but showing the section in a radiused orientation with dashed lines showing the section radiused in an opposite direction.

Extending inwardly in alternating and spaced apart relation from side walls 16 and 18 are channels 24, as can best be seen in FIGS. 1 and 2. Channels 24 are generally V-shaped and have an open end 26 and a closed end 28. Channels 24 allow incline section 10 to be manipulated into a radius as best seen in FIG. 6. In this orientation, open ends 26 of channels 24 become wider on side wall 18 and narrower on side wall 16 in the portion of section 10 that is radiused when incline section 10 is radiused toward side wall 16. Conversely, open ends 26 become wider on side wall 16 and narrower on side wall 18 in the portion of section 10 that is radiused when section 10 is radiused toward side wall 18. Section 10 can only be radiused to the point at which open ends 26 become completely closed. It can thus be seen that the width of open end 26 is a determining factor of the radius which can be obtained, along with the flexibility of the material used to form section 10. Section 10 can be made from any material that will allow it to flex and is preferably manufactured from a polystyrene material. The polystyrene provides a sturdy and lightweight base upon which the model train can be carried.

Figure 8:
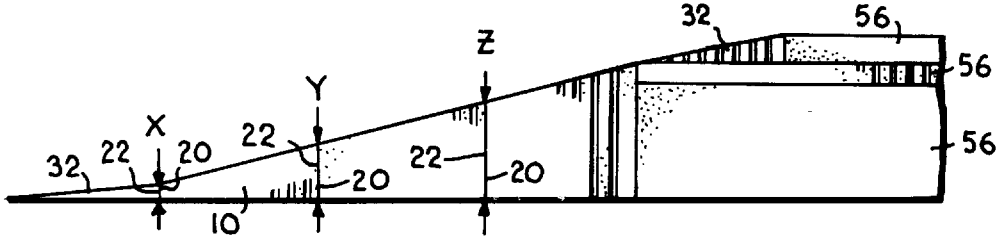
FIG. 8 is a side elevation view similar to FIG. 5 showing an increased grade and the use of riser sections to increase the length of the grade and the overall elevation achieved with the grade.
Figure 7:
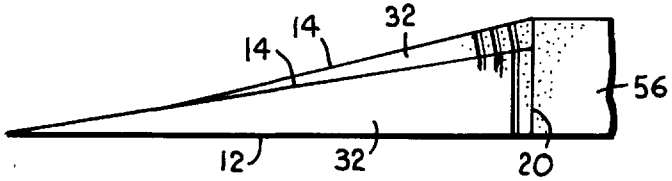
FIG. 7 is a side elevation view showing one graded section placed on top of another graded section to increase the grade to rise to a higher elevation in the same distance.

A first flexible section 32 is used to transition from a base elevation to a greater elevation, as shown in FIGS. 7 and 8. Section 32 is identical to section 10 in all respects except that it does not have an end wall 22. Instead, top surface 14 and bottom surface 12 substantially converge at the end opposite end wall 20.

Figure 4:
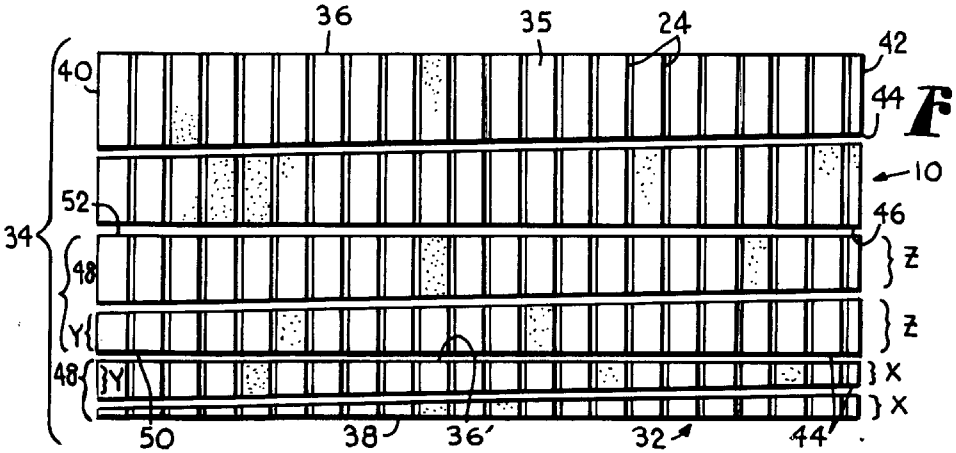
FIG. 4 is a side elevation view of a block of flexible sections, showing the formation of a series of incline sections from a single block of material.

In forming sections 10, a number of graded sections 10 are preferably formed from a single block 34 of material as best seen in FIG. 4, it being understood that other methods of forming sections 10 could be employed as known to those of skill in the art. Block 34 is made from the extruded polystyrene material of graded sections 10 and has sidewalls 35 with channels 24 formed therein. Block 34 has an upper wall 36 and a lower wall 38 that are parallel to one another. Further, block 34 has a first end wall 40 and a second end wall 42 which are parallel to one another and perpendicular to upper and lower walls 36 and 38.

Figure 5:
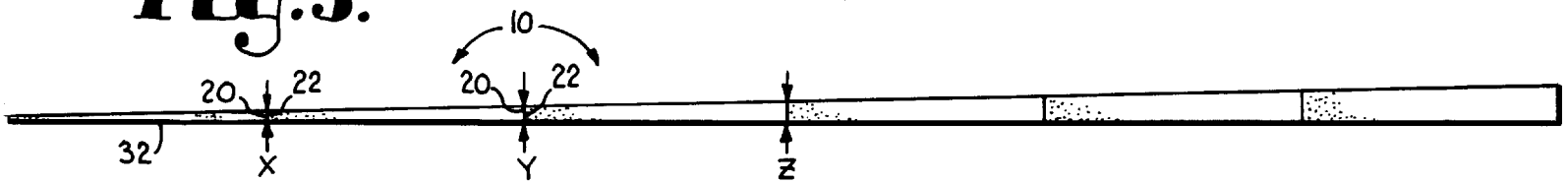
FIG. 5 is side elevation view of the incline sections of FIG. 4 placed in end-to-end relationship to form a continuous grade.

When only two incline sections 10 are to be made from block 34, the upper four sections shown in FIG. 4 will not be present. In this embodiment block 34 has an upper wall 36'. To form two sections 10 from block 34, a diagonal cut 44 is made from first end wall 40 to second end wall 42. More specifically, diagonal cut 44 is made from the intersection of first end wall 40 and lower wall 38 to a point that is a distance "x" from lower wall 38 that is midway between upper wall 36' and lower wall 38 along second end wall 42. Diagonal cut 44 therefore forms two sections that have an identical thickness "x" on one end. Two sections are therefore formed which may be placed in end to end relation with the two portions of second end wall 42, each having a thickness "x", placed in abutting relationship. More specifically, first section 32 is formed along with an additional section 10 that can be placed in abutting relationship with first section 32 to form an incline or a decline of constant and uniform grade, as best seen in FIG. 5.

If block 34 is to be divided into more than two sections, it is first necessary to make at least one parallel cut 46 through block 34 from first end wall 40 to second end wall 42 that is parallel to both upper wall 36 and lower wall 38. Parallel cut 46 is made so that two rectangular parts 48 are formed that have different thicknesses. For instance, when four sections 10 are to be formed from block 34, one parallel cut 46 is made through block 34 that is parallel to upper wall 36 and lower wall 38, forming two rectangular parts 48. Thereafter, each rectangular part 48 is further divided into sections 10 by making diagonal cuts 44 therethrough. The rectangular part 48 that has a lesser thickness is divided into first section 32 and section 10 in the same manner as that described above. The rectangular part 48 that has the greater thickness is divided into two sections 10 in a similar fashion. However, diagonal cut 44 that is made through the rectangular part 48 with the greater thickness is made from a point a distance "y" from a lower surface 50 to a point a distance "z" from lower surface 50 that is midway between lower surface 50 and an upper surface 52. Two sections 10 are therefore formed from rectangular part 48 which may be placed in end to end relation, with the two portions of second end wall 42, each having a thickness "z", placed in abutting relationship. Four sections 10 are therefore formed that can be placed in abutting end to end relation to form an incline or a decline with a constant uniform grade.

If it is desired to form additional incline sections 10 from block 34, it is necessary to first make a greater number of parallel cuts 46 through block 34 and to thereafter divide each of the rectangular parts 48 into two sections 10 by making diagonal cuts 44 therethrough. For instance, if six sections 10 are to be formed, block 34 is first divided into three rectangular parts 48 of thickness by making two parallel cuts 46 through block 34, as shown in FIG. 4. Thereafter, each of the three rectangular parts 48 is divided into two sections 10 by making diagonal cuts 46 therethrough. The sections 10 so formed can be placed in abutting end-to-end relationship to form an incline or decline with a constant, uniform grade as can best be seen in FIG. 5.

Section 10 is placed on a base 54 according to a layout that has been created and transferred to the base. The layout provides the location, shape and desired grades for track 11 and dictates where on base 54 sections 10 may be needed. Base 54 is preferably made from a lightweight and sturdy material, such as a sheet of plywood, polystyrene or other suitable base material. Section 10 is coupled to base 54, in a location needing either a rise or fall in elevation according to the layout, using an adhesive, or other suitable attaching means. Thus, no power tools or complicated methods are required to attach section 10 to base 54.

More specifically, a gradual incline can be formed on base 54 by placing a number of sections 10 in end to end relation as shown in FIGS. 5 and 8. In this embodiment, first section 32 is attached to base 54. End wall 20 of first section 32 will have a thickness "x". Thereafter, a section 10 can be placed in end-to-end relation with first section 32 that has an end wall 22 with a thickness "x" and an end wall 20 with a thickness "y". End wall 20 of first section 32 is placed in abutting relationship with end wall 22 of section 10. End wall 20 will thus have the same elevation as abutting end wall 22 so that a smooth transition is obtained from section to another. Additional sections 10 can thereafter be placed in end-to-end relation to form a longer incline or decline. For example, a section 10 having an end wall 22 with a thickness "y" and an end wall 20 with a thickness "z" can be placed in end-to-end relation with the previous section 10 so that the end walls with the "y" thicknesses are in abutting relationship. Additional sections may be added in a similar manner. In this fashion, a gradual incline or decline may be formed which has a continuous and uniform grade. For example, an incline can be formed that rises from base 54 to an elevation of 3½ inches over a length of fourteen feet forming an incline with a 2% grade, it being understood that a 1% grade corresponds to a one foot rise per one-hundred linear feet. In this embodiment, seven sections 10 are used that are each two feet in length.

As stated above, a 3% or 4% grade may be desired. To form a 3% grade, a first section 32 is preferably used that rises from base 54 to an elevation of ½ inch over a length of two feet. Thus, first section 32 used in the 3% grade incline is actually a 2% grade. Thereafter, four sections 10 can be coupled to first section 32 that will rise from an elevation of ½ inch to 3½ inches. The incline formed will rise from zero to 3½ inches over a length of ten feet. Similarly, to form a 4% grade incline, it is preferable to have first section 32 rise from base 54 to an elevation of ½ inch over two feet, which is a 2% grade. Thereafter, three sections 10 can be coupled to first section 32 that will rise from ½ inch to an elevation of 3½ inches over a length of six feet. Therefore, a 4% grade incline can be formed that rises from zero to 3½ inches in elevation over a length of only eight feet.

In a typical model layout, at least one incline and one decline will be formed therein. For example, a 4% grade incline could be included that rises from zero to 3½ inches over a length of eight feet which could be followed by a 2% decline which falls from an elevation of 3½ inches to a base elevation of zero inches over a length of fourteen feet. Further, it is often desired to maintain a constant elevation for a certain length in between the incline and the decline. In order to achieve this constant elevation between the incline and the decline, a riser section 56 may be secured to base 54 between the last section 10 of the incline and the first incline section 10 of the decline. Riser section 56 is secured to base 54 in the same fashion as that used to secure incline sections 10 to base 54. Further, riser section 56 has a series of channels formed therein (not shown) similar to channels 24 of incline section 10. Therefore, riser section 56 is also flexible and can be shaped to conform to a desired radius. Further, riser sections 56 can be formed in a variety of thicknesses, as seen in FIG. 8, to allow a variety of constant elevations to be maintained. It can therefore be seen that a series of incline sections 10 can be placed in end to end relation to form an incline, which can be followed by a series of riser sections 56 to form an area of constant elevation, which can be followed a series of incline sections 10 placed in end to end relation to form a decline. Therefore, incline sections 10 and riser sections 56 can be used to elevate track 11 to a desired elevation, maintain that elevation for a desired length and thereafter return track 11 to base 54 or a zero elevation. Further, each of the incline sections 10 and riser sections 56 are capable of being manipulated into a radius to conform to the particular layout for track 11.

If it is desired to increase the length and overall elevation of the incline or decline, a number of riser sections 56 are placed on base 54 immediately following the last section 10 of the incline or decline that corresponds to the elevation achieved thereby. Thereafter, a first section 32 is placed on top of riser section 56 and is secured thereto by an adhesive or other suitable attaching means. It can thus be seen that the use of riser sections 56 and incline sections 10 and 32 can increase the elevation and length of the incline. Similarly, the length of a decline may be increased as well as the height from which the decline falls.

In one embodiment of the invention, a set of incline sections 10 can be purchased which rise from zero to 3½ inches in elevation. In a 2% grade system, this rise would take place over fourteen feet and would encompass seven incline sections 10. In a 3% grade system, this rise would take place over a length of ten feet and would include five incline sections 10. Finally, in a 4% grade set this rise would take place over eight feet and would include four incline sections 10.

After sections 10 and any needed riser sections 56 have been applied to base 54, it is necessary to complete installation of the track and any landscaping thereof. Prior to attaching track 11, it is preferable to attach a track bed (not shown) to the top surface of sections 10 and riser sections 56. The use of a track bed, which is also known as a roadbed, is known to those of skill in the art. The track bed is typically made from cork or a rubber material and is attached using an adhesive or other suitable attaching means. Track 11, equipped with ties 60, is then attached to the top of the track bed, using an adhesive, small nails or other suitable attaching means. After installation of track 11, it is preferable to install a ballast 58 to enhance the appearance of the assembly. Ballast 58 can be any of a number of materials, such as ground cork or vinyl, rock, sand or other aggregate material. Thereafter, terrain features such as rocks, tunnels and retaining walls can be added to enhance the appearance and realism of the layout, as is shown in FIG. 2, and as is well-known in the art.

In another embodiment of the present invention, a method is provided for creating an incline or a decline for an artificial landscape. The method involves attaching to a base a flexible section which has a generally planer bottom and a top extending at an angle relative thereto. The section has a series of channels formed therein which allow the section to be positioned in a radius. The method further includes manipulating the section into a radius when it is desired to form an incline or decline around a curve. The method further includes coupling a plurality of the sections in abutting, end to end relation so that a roadbed having a continuous grade is formed. When the desired layout includes at least one incline and at last one decline, a method is provided that includes attaching to the base at least one flexible section for the incline and at least one flexible section for the decline. Further, when a constant elevation section is desired in between the incline and the decline, the method includes attaching a flexible section of constant elevation to the base in between the incline and the decline.

From the foregoing, it will be seen that this invention is one well adapted to attain all the ends and objects hereinabove set forth together with other advantages which are obvious and which are inherent to the structure. It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A method of creating an incline for a roadbed on an artificial landscape, said method comprising:

coupling to a generally planar base in a desired location a first flexible section of a given length, said section having a generally planar horizontally extending bottom abutting said base substantially along its entire length a generally planar top extending at a non-zero angle relative to said bottom where said bottom is coupled to said base and first and second side walls having a series of channels extending into said section that allow said section to be positioned in a radius.

2. The method according to claim 1, wherein said first section has a thickness "x" at one end and wherein said method further comprises coupling to said base a second section, identical to said first section except for having a thickness "x" at one end and a greater thickness "y" at the other end, in abutting relationship with said first section so that said "x" thickness end of said first section abuts said "x" thickness end of said second section to present a roadbed of continuous grade.

3. The method according to claim 2, wherein additional sections, identical to said second section except that the average thickness of each of said additional sections is increasingly greater than the average thickness of said second section, are placed in abutting relationship with said second section and in end-to-end relation to increase the length and height of said roadbed.

4. The method according to claim 2, wherein said coupling step includes manipulating said first and second sections into a radius to conform to a curve.

5. The method according to claim 1, wherein at least one incline and at least one decline are included, said method further comprising coupling to said base at least one said flexible section for said incline and at least one said flexible section for said decline.

6. The method according to claim 5, further comprising creating a section of increased elevation in between said incline and said decline by attaching a number of preformed flexible riser segments having a constant elevation to said base to connect said incline to said decline.

7. The method according to claim 5, further comprising increasing the grade of said incline and said decline by attaching to said top of said flexible sections at least one additional flexible section having a generally planar bottom, and a top extending at a non-zero angle relative to said bottom.

8. The method according to claim 7, further comprising adding to the length of said incline and said decline by attaching to said base a number of said riser segments and attaching to said riser segments at least one of said flexible sections.

9. Structure for creating a roadbed having a grade for an artificial landscape, said structure comprising a flexible first section of a given length, said section having a generally planar horizontally extending bottom, a generally planar top extending at a non-zero angle relative to said bottom along the entire length of said section and first and second side walls, said first side wall having a series of channels that extend into said section in spaced apart relation, said second side wall having a series of channels that extend into said section in spaced apart relation offset from said channels of said first wall.

10. The structure of claim 9, wherein said channels allow said first section to be positioned in a radiused orientation.

11. The structure of claim 10, wherein said first section has a thickness "x" at one end and wherein is included a second section identical to the first mentioned section except for having a thickness "x" at one end and a greater thickness "y" at the other end, said sections being placed with their "x" thickness ends in abutting relationship to present a roadbed of continuous uniform grade.

12. The structure of claim 11, wherein said sections are formed from polystyrene.

13. The structure of claim 11, wherein said channels are generally v-shaped.

14. The structure of claim 11, wherein said first and second sections are manufactured from a single rectangular block of material having an upper planar wall, a lower planar wall parallel to said upper planar wall and first and second end walls disposed between said upper wall and said lower wall, said sections being made by making a diagonal cut through said material from said first end wall to said second end wall starting at a point a distance of said thickness "y" down from said upper wall and ending at a point midway between said upper wall and said lower wall, said midway point being a distance of said thickness "x" from said lower wall, said diagonal cut forming two sections wherein said top of each said section is formed by said diagonal cut and said planar bottom of one section is formed by said upper wall and said planar bottom of said other section is formed by said lower wall.

15. The structure of claim 9, wherein said first section, and a plurality of additional sections that are identical to said first section except that the average thickness of each of said additional sections is increasingly greater than said first section, are manufactured from a single rectangular block of material having an upper planar wall, a lower planar wall and a pair of end walls by making at least one cut through said block that is parallel to said upper planar wall and said lower planar wall to form a plurality of rectangular parts of different thicknesses, each said part having parallel spaced apart upper and lower walls, said part having a lesser thickness being further divided into said first section and one said additional section by making a diagonal cut through said material from one end wall to the other starting at a first point a distance "y" down from said upper wall of said rectangular part and ending at a point midway between said upper wall and said lower wall of said rectangular part, said midway point being a distance "x" down from said upper wall, said part having a greater thickness being further divided into two of said additional sections by making a diagonal cut through said material from one end wall to the other starting at a first point a distance "y" from said lower wall of said rectangular part and ending at a point midway between said upper wall and said lower wall of said rectangular part, said midway point being a distance "z" down from said upper wall.

16. The structure of claim 15, wherein said top of each section has the same grade so that said first section and said additional sections are positionable in abutting relationship to one another to form a roadbed having a continuous grade.

17. Structure for creating a roadbed having a grade for an artificial landscape, said structure comprising a flexible first section having a generally planar bottom, a top extending at an angle relative to said bottom and first and second side walls, said first side wall having a series of channels that extend into said section in spaced apart relation, said second side wall having a series of channels that extend into said section in spaced apart relation offset from said channels of said first wall, wherein said channels allow said first section to be positioned in a radiused orientation, and wherein said first section has a thickness "x" at one end and wherein is included a second section identical to the first mentioned section except for having a thickness "x" at one end and a greater thickness "y" at the other end, said sections being placed with their "x" thickness ends in abutting relationship to present a roadbed of continuous uniform grade.

* * * * *

UNITED STATES PATENT AND TRADEMARK OFFICE

CERTIFICATE OF CORRECTION

PATENT NO. : 5,839,657

DATED : November 24, 1998

INVENTOR(S) : C. Dwayne Fulton and David L. Osment

It is certified that error appears in the above-indentified patent and that said Letters Patent is hereby corrected as shown below:

In column 5, line 16, after the word "of" please insert the word --increasing--.

Signed and Sealed this

Thirteenth Day of July, 1999

*Attest:*

*Attesting Officer*

Q. TODD DICKINSON

*Acting Commissioner of Patents and Trademarks*